US009624024B2

(12) United States Patent
Vilinsky

(10) Patent No.: US 9,624,024 B2
(45) Date of Patent: Apr. 18, 2017

(54) PUSH UP CEREAL CUP

(71) Applicant: Noah Vilinsky, Brooklyn, NY (US)

(72) Inventor: Noah Vilinsky, Brooklyn, NY (US)

( * ) Notice: Subject to any disclaimer, the term of this patent is extended or adjusted under 35 U.S.C. 154(b) by 49 days.

(21) Appl. No.: 14/400,728

(22) PCT Filed: May 17, 2013

(86) PCT No.: PCT/US2013/041657

§ 371 (c)(1),
(2) Date: Nov. 12, 2014

(87) PCT Pub. No.: WO2013/173762

PCT Pub. Date: Nov. 21, 2013

(65) Prior Publication Data

US 2015/0166246 A1 Jun. 18, 2015

Related U.S. Application Data

(60) Provisional application No. 61/648,511, filed on May 17, 2012.

(51) Int. Cl.
*B65D 25/04* (2006.01)
*B65D 43/02* (2006.01)
(Continued)

(52) U.S. Cl.
CPC ..... *B65D 83/0005* (2013.01); *A47G 19/02* (2013.01); *B65D 25/04* (2013.01);
(Continued)

(58) Field of Classification Search
CPC .... B65D 83/0005; B65D 25/04; B65D 43/02; B65D 85/80; B65D 85/00; B65D 85/02;
(Continued)

(56) References Cited

U.S. PATENT DOCUMENTS 4,753,373 A * 6/1988 Seager ..... B65D 83/0011 222/151
4,899,419 A 2/1990 Saleen
(Continued)

FOREIGN PATENT DOCUMENTS

CL 199700897 2/1998
CL 200603008 6/2007
(Continued)

OTHER PUBLICATIONS

Extended European Search Report for Application No. 13791324 dated Nov. 18, 2015.
(Continued)

*Primary Examiner* — Michele L Jacobson
*Assistant Examiner* — Ericson M Lachica
(74) *Attorney, Agent, or Firm* — Lerner, David, Littenberg, Krumholz & Mentlik, LLP

(57) ABSTRACT

The disclosed embodiments relate generally to a system and method of using a push up cereal cup or box (PUCC). The system includes a top and bottom compartment that contains at least one liquid and at least one foodstuff. The device allows consumption of a mixture of liquid and foodstuff, such as cereal and milk, without the use of any utensils.

10 Claims, 10 Drawing Sheets

(51) Int. Cl.

| | |
|---|---|
| ***B65D 85/80*** | (2006.01) |
| ***B65D 83/00*** | (2006.01) |
| ***B65D 81/32*** | (2006.01) |
| ***A47G 19/02*** | (2006.01) |
| ***B65D 77/28*** | (2006.01) |

(52) U.S. Cl.

CPC ..... *B65D 43/02* (2013.01); *B65D 77/286* (2013.01); *B65D 81/3211* (2013.01); *B65D 83/0055* (2013.01); *B65D 85/80* (2013.01); *A47G 2400/062* (2013.01)

(58) Field of Classification Search

CPC ..... B65D 85/08; B65D 85/14; B65D 85/20; B65D 85/72; B65D 85/60; B65D 81/32; B65D 81/3205; B65D 81/3211; B65D 81/3216; B65D 2585/00; B65D 1/32; B65D 83/00; B65D 81/325; B65D 81/3255; B67D 1/0004; B67D 1/0005; A23G 3/56

USPC ..... 426/112, 115, 394, 119, 120, 130; 220/505, 501, 506, 502, 503, 521, 522, 220/711, 714, 715, 527, 528, 23.86, 220/23.87; 206/804, 217; 222/94, 129, 222/135, 192, 207, 212, 213, 386, 387, 222/391, 145.3, 454, 481.5, 325, 522, 222/526, 555, 561, 402.12, 509, 151; 210/482, 95, 295, 455, 474; 221/96, 278

See application file for complete search history.

(56) References Cited

U.S. PATENT DOCUMENTS

| | | | | |
|---|---|---|---|---|
| 5,241,835 | A | 9/1993 | Ascone | |
| 5,353,961 | A | 10/1994 | Debush | |
| 6,264,068 | B1 | 7/2001 | Ours et al. | |
| 6,913,777 | B2 | 7/2005 | Rebhorn et al. | |
| 2003/0000851 | A1 | 1/2003 | Walsh et al. | |
| 2006/0049207 | A1 | 3/2006 | Bogoshian et al. | |
| 2009/0311389 | A1 | 12/2009 | Zoss et al. | |
| 2010/0260901 | A1* | 10/2010 | Zoss | A47G 19/02 426/120 |
| 2012/0058229 | A1 | 3/2012 | Tseng | |

FOREIGN PATENT DOCUMENTS

| | | | |
|---|---|---|---|
| CL | 200701633 | | 1/2008 |
| CN | 1059127 | A | 3/1992 |
| WO | 2009152231 | A1 | 12/2009 |

OTHER PUBLICATIONS

International Search Report for Application No. PCT/US2014/065291 dated Feb. 4, 2015.

Shah, M. "Advantages of Hot Melt Adhesive" Ezine Articles, Oct. 26, 2009.

Chile Search Report for Application No. 201403120 dated Nov. 17, 2014.

International Search Report for Application No. PCT/US13/41657 dated Jun. 30, 2013.

Supplementary European Search Report for Application No. EP13791324 dated Nov. 10, 2015.

* cited by examiner

PUSH UP CEREAL CUP

CROSS-REFERENCE TO RELATED APPLICATION

This application claims the priority of U.S. Provisional Application Ser. No. 61/648,511 filed May 17, 2012, the entire disclosure of which is expressly incorporated herein by reference.

TECHNICAL FIELD OF THE INVENTION

An apparatus and method for consuming cereal or like material is disclosed herein and more particularly a push up cereal box disclosed provides ease of use of cereal without a spoon, and convenient holding of the cereal and milk together.

BACKGROUND

Many of today's working environments give rise to the need for consumable on the go. For example, many breakfast type foods are made to grab and run. However, these types of food stuffs are limited to snack bars, shakes and the like. If a person wanted to have cereal for breakfast the need of using a spoon prohibits the grab and run convenience. Also in times of relaxation, such as but not limited to camping, utensils may be cumbersome to use or not available.

Thus, there still remains in the art a need for a device that allows a user to consume a foodstuff such as cereal that does not involve burdensome use of a spoon. The device needs to be aesthetically pleasing and easy to use. There is also a need in the art for such a device that can withstand the vigorous forces of cleaning and allow ease of storage of both a liquid, such as but not limited to milk, and a food stuff, such as but not limited to cereal.

SUMMARY

The present invention provides for a push up cereal box. The box may be made of two compartments that holds the food stuff, such as cereal, and another compartment to hold a liquid such as milk. These compartments are separate and not in communication with each other. The compartments may be microwave and dishwasher safe to be reused. The separable compartments allows the user to use foodstuff and liquid of his or her own choice. The box may, depending on the embodiment, include an outlet tube where the liquid and food stuff are served to a user.

The liquid and food stuff may be controlled by one or more external control buttons that would allow a user to control the flow of liquid, and food stuff. A tray is used to elevate the food stuff to a cup. A mesh or perforated cup would hold a controllable portion of the foodstuff to allow the liquid to pass through. Delivery of the combined liquid and food stuff may be accomplished by squeezing the external tube and using pressure to extrude the mixture out or by using gravity and tilting the device.

Several unexpected results occur when utilizing the push up cereal box. The box may be positioned to allow the user to firmly secure the device during consumption of the food stuff and liquid without use of utensils such as a spoon.

A cereal tray may also be incorporated in one of the compartments. One of the intended purposes of the cereal tray is to ensure there is no waste of cereal and to control cereal consumption. The cereal tray is controlled by the user through a switch that enables lifting of the base and/or cereal tray, depending on the embodiment. A spring or other resilient member may be used to assist the tray to push the foodstuff upward. A external control switch would control the amount of extension allowed and hence control the amount of food stuff delivered to the cup for mixing. The liquid has no access to the cup other than passing through it after the food stuff is delivered to the cup.

The foregoing objects are achieved and other features and advantages of the present invention will become more apparent in light of the following detailed description of exemplary embodiments thereof, as illustrated in the accompanying drawings.

BRIEF DESCRIPTION OF THE DRAWINGS

In the drawings, wherein similar reference characters denote similar elements throughout the several views.

DETAILED DESCRIPTION OF THE DRAWINGS

Figure 1:
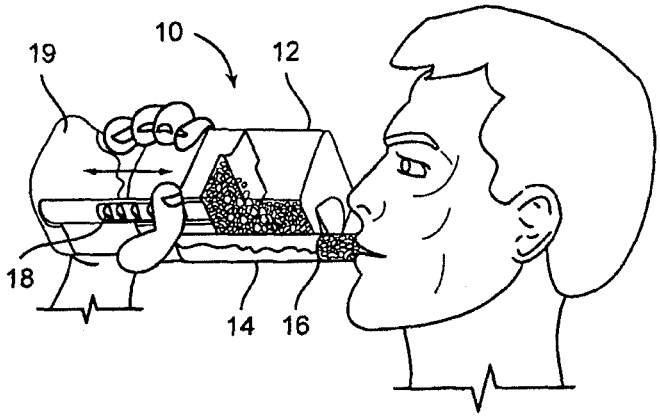
FIG. 1 shows a side view of one embodiment illustrating an extended version of the cereal box showing an internal view.

The invention will now be described in detail with reference to the accompanying drawings. The present invention relates to an apparatus and method for a push up cereal cup (hereinafter PUCC). The PUCC is to enjoy cereal & milk together without the use of a spoon. The PUCC comes, depending on the embodiment, in the form of a drinking bottle with a top spout used for consuming milk & cereal together. The bottle is divided into 2 sections. The bottom section holds the milk or other liquid, and the top portion holds the cereal, keeping it separate from the milk. One special feature is an integrated push up button/switch that enables the user to have control of the cereal portion by sliding the button/switch up & down with the touch of a finger.

This feature helps control cereal consumption, and ensures that there is none or little cereal waste. The preferred materials used for manufacturing the PUCC can be a variety of plastics that are best suited for production and food consumption. The size & shape may vary. The PUCC has been tested repeatedly with the current size & specifications for maximum ease of use and enjoyment. The PUCC works well with most cereals. The PUCC can be pre-packed with the cereal inside and sold as a disposable package. Also, the PUCC can be constructed from heavier/sturdier materials to be reusable and sold as a single unit. The PUCC has the hopes for mass production. Milk for the most part would be purchased separately and poured into the PUCC. Case in point, the PUCC gives you the convenience to enjoy cereal & milk together without the use of a spoon. The PUCC is the easiest way to enjoy cereal when you are on the go or relaxing, anywhere, anytime.

This invention has the ability to have the compartments fixedly attached or removably attached depending on the embodiments. The cereal box compartments may be disposed on angular dimension, either removably or fixedly attached or both if there are multiple compartments for each of the liquid and food stuff. Preferably, the liquid compartment is on the bottom and the foodstuff is on the top of the device when the device is sitting vertically and not in use. The box can be used for other foodstuff instead of cereal. The compartments may be snapped together and filled separately so that a user can fill each compartment separately with his or her own foodstuff and liquid.

This invention overcomes the issue of needing a spoon when eating cereal and other such foodstuff. Thereby, a grab and go or mobile solution to a past problem is resolved. The following examples and drawings will be described in terms of the food stuff being cereal and the liquid being milk. This invention is not so limited to cereal and milk and can be incorporated into any foodstuff and liquid where the mixture of the two are preferred or in the alternative where only one or the other are preferred to be consumed one at a time. The description is given merely to assist in demonstrating some of the principles of the invention.

In FIG. 1, a cereal box 10 includes a solids compartment 12 and a liquid compartment 19. The liquid compartment may be made of a flexible material as to squeeze the compartment to form internal pressure and move the liquid up tube 14. The compartments are in connection by a finger switch 18. Depending on the embodiment, outlet 14 may include a mesh cup to allow fluid to pass through while holding a portion of the foodstuff from foodstuff compartment.

Figure 2:
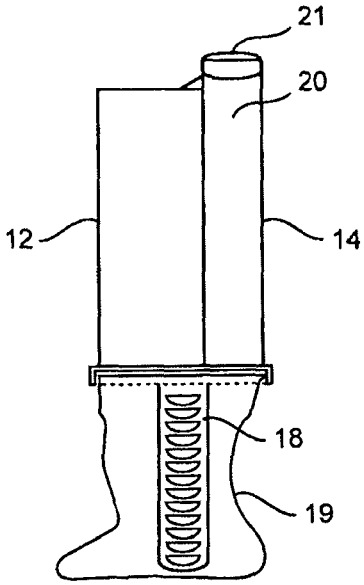
FIG. 2 shows a side view of one embodiment illustrating the cereal box of FIG. 1 showing an external view.

FIG. 2 illustrates an exploded version of FIG. 1. The upper and lower compartments are preferably joined. Joining may be accomplished by hot gluing, snap fits, ultrasonic welding and the like. The outlet or tube 14 defines a hole or access port 20 that allows flow of the foodstuff and liquid. A cap 21 may cover access port 20 when the box is being stored.

Figure 3A:
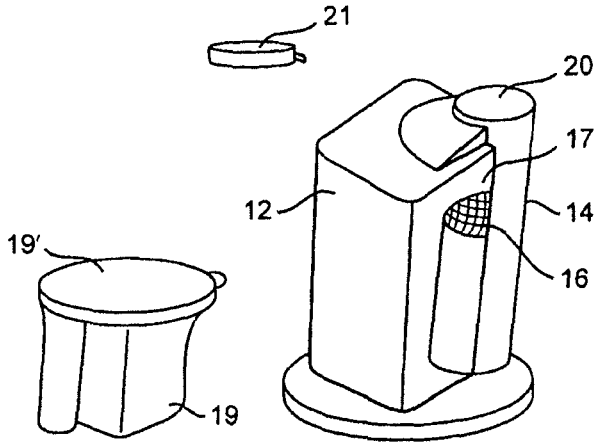
FIGS. 3A-3B shows another embodiment side view illustrating the top and bottom compartments disassembled together.
Figure 3B:
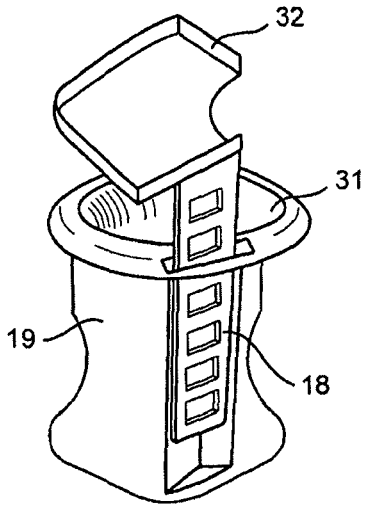

In FIGS. 3A-B, demonstrated is finger switch 18 mobility to move a cereal base or tray 32 that moves in a generally vertical direction. The movement of the cereal base is controlled by the finger switch 18, and controls the flow of the foodstuff. FIG. 3A shows the removable cap 21 and lower compartment 19. Lower compartment 19 may be covered with a lid 19' that is also removable. Again both compartments may be microwavable and washable to be reused and refilled. Also shown in FIG. 3A is an internal view of cup 16 and first opening 17. The cup may be perforated or meshed to allow liquid to flow therethrough from the tube 14. In FIG. 3B shown is lower compartment 19 having liquid flowing through a second opening 31. The tray 32 only has access to the upper compartment not the lower compartment. Liquid flows through second opening 32 to tube 14 and then through cup 16 out to access port 20.

Figure 4A:
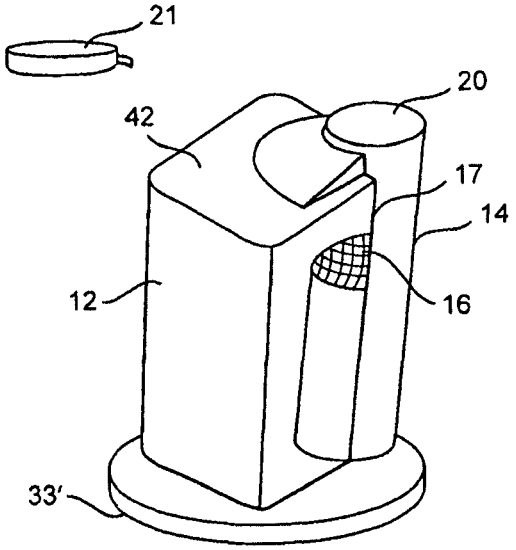
FIGS. 4A-C shows the cereal box in one embodiment with the top open, disassembled and assembled with the bottom.
Figure 4B:
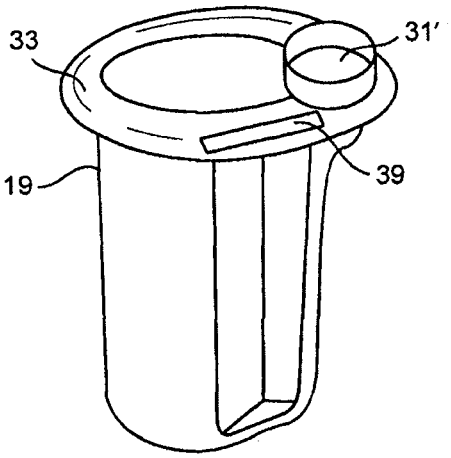
Figure 4C:
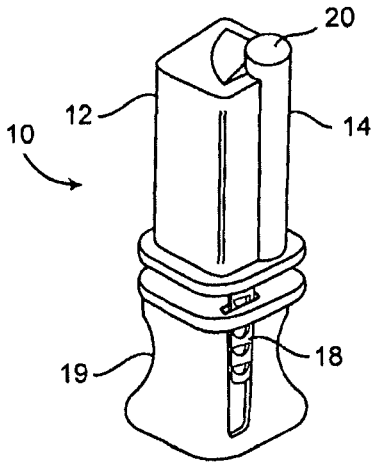

Adverting to FIG. 4A, illustrated is an internal embodiment of the invention. A top 42 is removable to allow access to the foodstuff compartment for refilling. Depending on the embodiment, the finger switch 18 or 40 (shown in FIG. 6B) on liquid compartment 19 may have concave structure for ease of use. Liquid compartment 19 may include but is not limited to milk, water (hot or cold), juice, and the like. Snap fits 33 and 33' connect the upper compartment 12 to the lower compartment 33. A slit 39 in lower compartment 19 allows the switch 18 or 40 to move. Another embodiment of second outlet 31' is shown in in FIG. 4B. the outlet provides flow of the liquid out of the lower compartment and into tube 14.

Figure 5A:
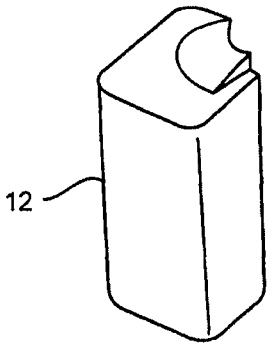
FIGS. 5A-F show another embodiment of the top, bottom, and cup.
Figure 5B:
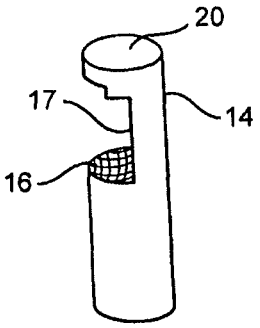
Figure 5C:
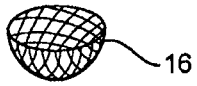
Figure 5D:
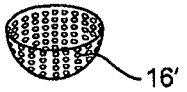
Figure 5E:
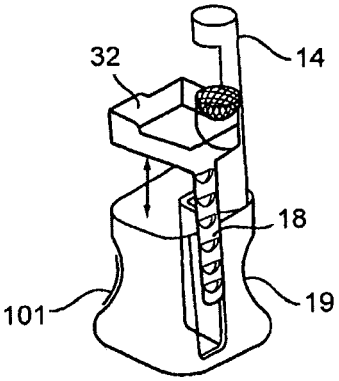
Figure 5F:
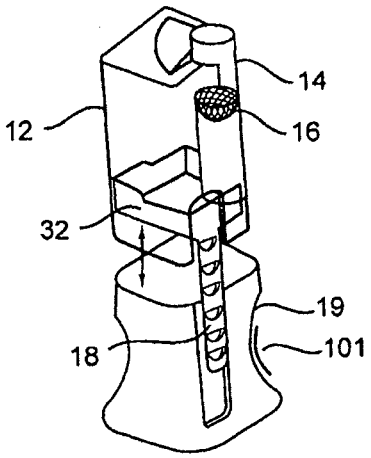

FIG. 1 illustrates the use of the cereal cup. Flow of the liquid is controlled in part on the angle of the container held by a user. The user controls the flow of the food stuff by moving the cereal base 32 using finger switch 18. Alternatively as shown in the drawings fluid flow is controlled by restrictions in tube 14 that are controllable by a switch. The lower compartment may be made of a flexible material such as polypropylene that allows a user to squeeze the liquid out of the tube without tilting the system. FIG. 5A shows an exploded or disassembled view of the top compartment 12. FIG. 5B shows tube 14 disassembled from compartment 12. Shown is first opening 17 and cup 16. FIG. 5C and 5D show various embodiments of the cup. Shown is a mesh cup 16 and a perforated cup 16'. The cup may be any design that allows liquid to flow therethrough while holding foodstuff. FIGS. 5E and 5F show that the lower compartment may have contours 101 to allow ease of handling and allow a user to squeeze liquid out of lower compartment 19.

Figure 6A:
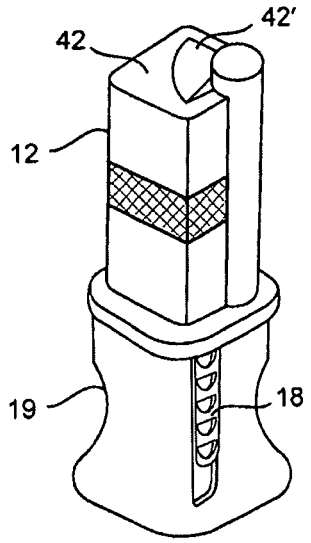
FIGS. 6A-C show embodiments of a sliding finger switch used to control foodstuff flow in the cereal box.
Figure 6B:
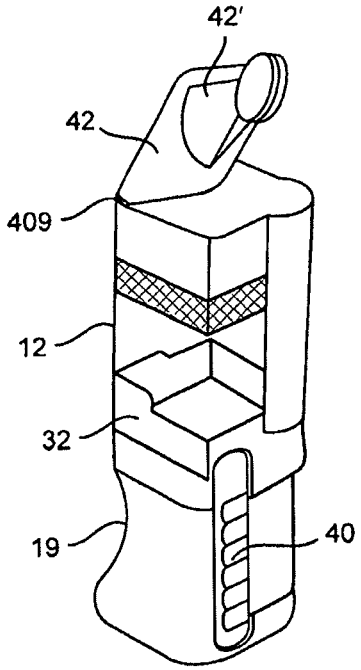
Figure 6C:
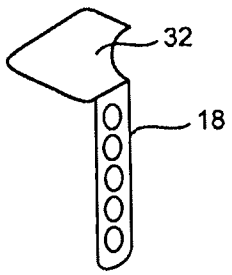

In one embodiment, FIGS. 6A, 6B, 6C illustrates a sliding finger switch using various structures including a concave structure. This allows finger insertion to slide the finger switch up and down and move the cereal base respectively. A friction spot on the foodstuff compartment keeps the cereal base in place when the cereal base slides through, thereby fixing the cereal base in the last placed position. Foodstuff slant 42' allows ease of flow of foodstuff when the foodstuff is moved to the cup. Square or rectangle shape is very instrumental for flow of food stuff. Slanted angles to drop foodstuff into the cavity are also useful. A hinge 409 allows cover 42 to move alternatively in reference to compartment 12 for filling of the compartment.

Figure 7A:
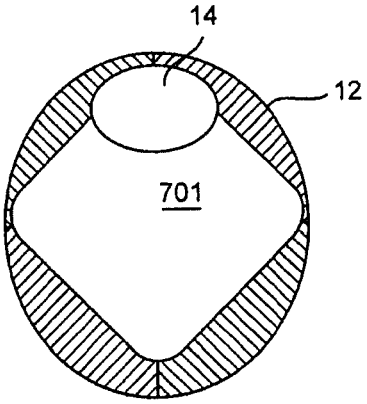
FIGS. 7A-D show bottom view of foodstuff container, top view of liquid container, and two cap dividers for the liquid container, respectively.
Figure 7B:
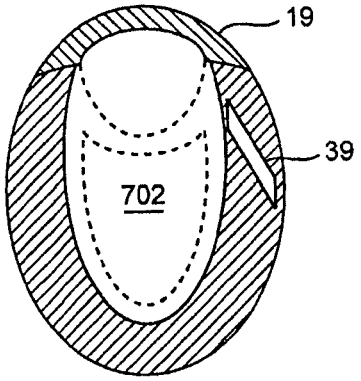
Figure 7C:
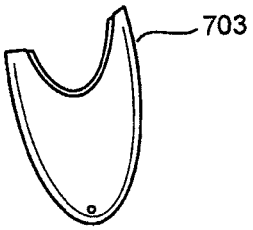
Figure 7D:
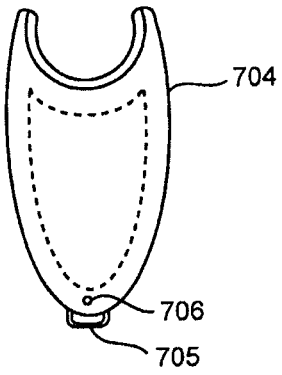
Figure 8A:
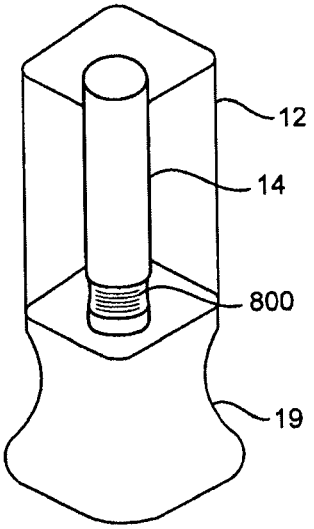
FIGS. 8A-C show embodiments utilizing a liquid control button.
Figure 8B:
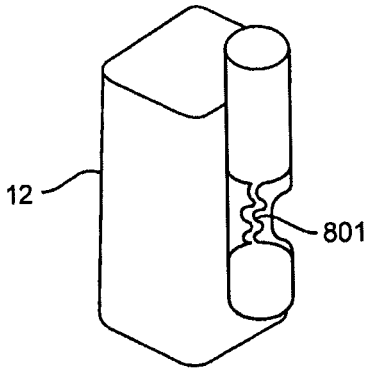
Figure 8C:
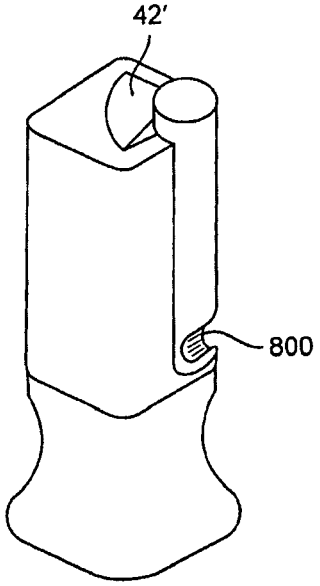

FIG. 7A is a bottom view of upper compartment and FIG. 7B is a top view of the liquid compartment. Food stuff is stored separately in cavity 701 and liquid separately in lower compartment cavity 702. A lid 703 or 704 may be used to cover the lower compartment during storage. Lid 704 may have an air hole 706 and a snap fit 705 to assist in attachment. A slit 39 is also shown in FIG. 7B for the finger switch.

Figure 9A:
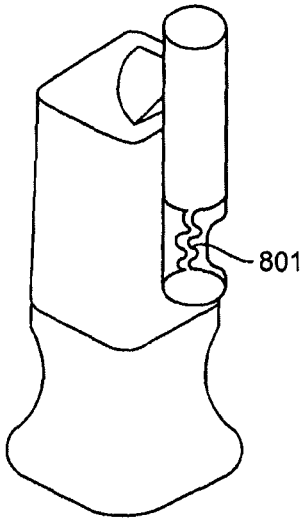
FIGS. 9A-F show embodiments of flow control of the liquid container.
Figure 9B:
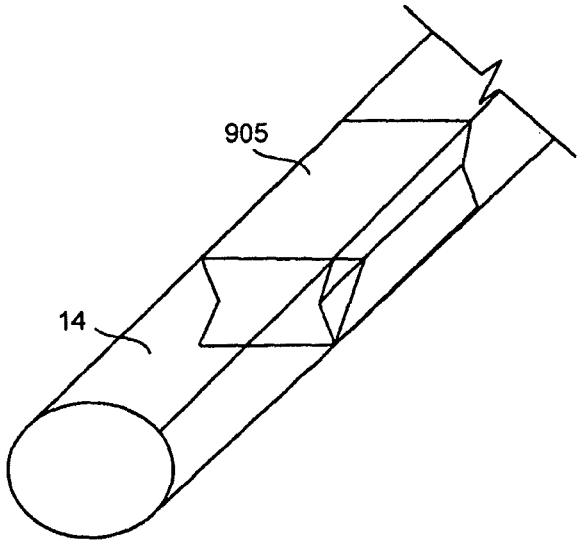
Figure 9C:
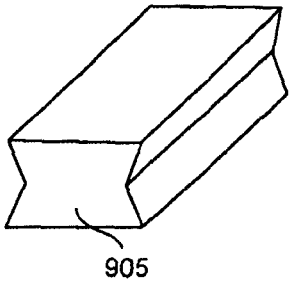
Figure 9D:
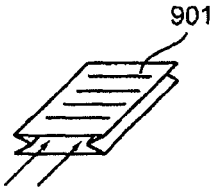
Figure 9E:
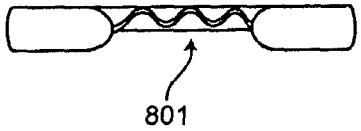
Figure 9F:
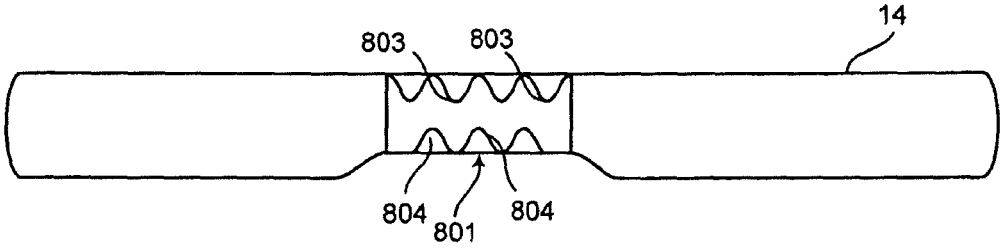
Figure 10A:
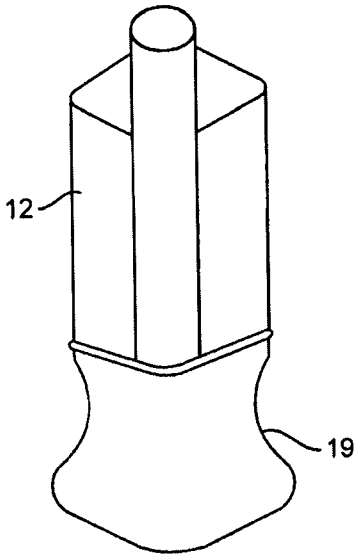
FIGS. 10A-E show embodiments of squeeze control for the foodstuff tray.
Figure 10B:
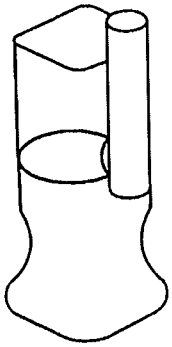
Figure 10D:
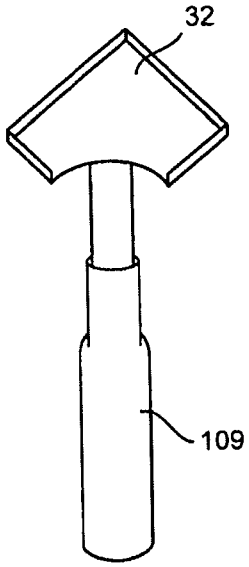
Figure 10C:
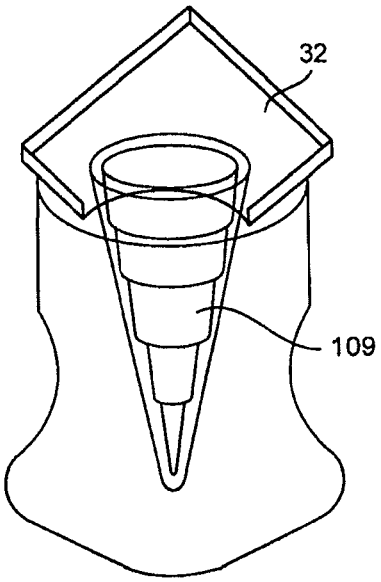
Figure 10E:
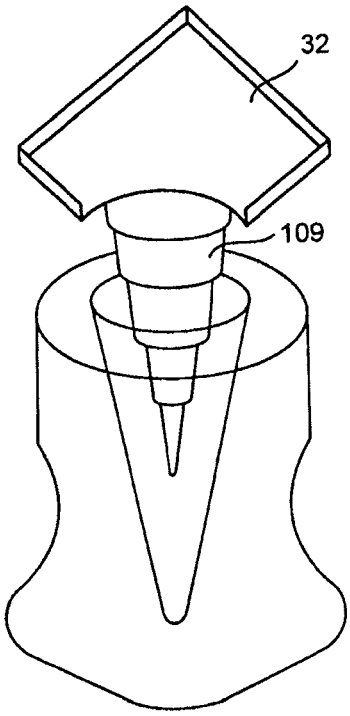

FIGS. 8A, 8B, and 8C and FIGS. 9A, 9E, and 9F show switch 800 and 801 that control the flow of liquid from the compartment. FIGS. 9A-9F show the liquid switch in the open and closed positions. Shown in FIG. 9D is liquid flowing to the switch in a closed position 901 and FIG. 9C in an open position 905. The switch may be pressed to close, and the switch is disposed in tube 14. Teeth 803 and 804 as shown in FIG. 9F may act as a snap fit that can open and close by applying pressure to the outside of the tube 14.

Figure 11A:
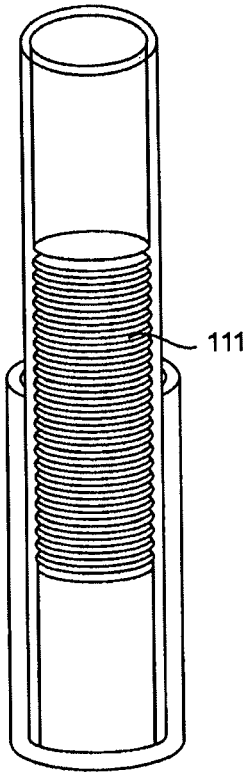
FIGS. 11A-B show embodiments of a tray that is propelled vertically by a spring or other resilient member.
Figure 11B:
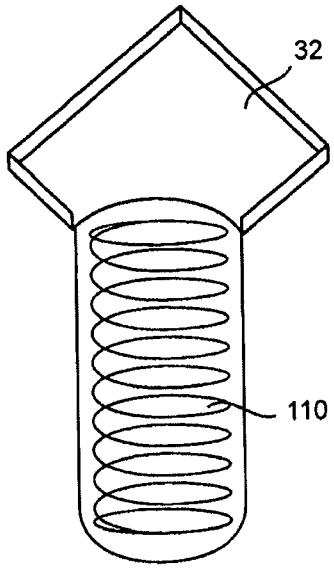

FIGS. 10A through 10E show a press straw 109 embodiment where instead of the finger switch pressure applied to the lower compartment moves the tray 32. Liquid may also be moved by applying pressure to the lower compartment or by tilting the system horizontally. Alternatively FIGS. 11A and 11B illustrate that tray 32 may be propelled vertically by a spring 110 or other resilient member 111. The control of the movement of the tray 32 would be by the finger switch which would have ridges to stop movement from the spring. As previously described in absence of a spring or resilient member, mechanical motion of the tray would be manually by the finger switch and tray assembly shown and described.

Again, depending on the embodiment, the liquid portion compartment may be either at the top or bottom of the cereal box or PUCC. The liquid compartment may be composed of one or more compartments. In addition the foodstuff compartment may be composed of one or more compartments.

Other alternative embodiments or implementations according to the various teachings of the present invention will be understood by those skilled in the art and are achieved without departing from the spirit and scope of the invention. In accordance with the scope of the invention, the PUCC may be a unitary structure or comprise multiple components, or combination of both. It is therefore intended that the present invention is not limited to the disclosed embodiments described herein but should be defined in accordance with the claims that follow.

What is claimed is:

1. A push up cereal box, comprising:

a bottom compartment defining a first outlet;

a top compartment defining a second outlet;

the bottom compartment containing a liquid and the top compartment containing a foodstuff, and both compartments are not in fluid communication with each other;

a tube connected to the bottom compartment and having a user access port;

the tube connected to the bottom compartment through the first outlet;

a perforated cup having holes disposed in the tube, the cup having access to the top compartment through the second outlet for allowing liquid to flow therethrough from the tube;

an external moveable finger switch for controlling the foodstuff;

an internal moveable tray in the top compartment and connected to the external moveable finger switch, the switch connected to the internal moveable tray for moving the internal moveable tray and controlling the amount of flow of foodstuff to the cup, the external moveable finger switch positioned below the internal moveable tray and provides vertical movement of the tray in an upward motion, and a downward motion for refilling the tray;

a cover disposed over the access port and removable such that when the cereal box is tilted horizontally or when the bottom compartment containing the liquid is squeezed and the finger switch moved to an on position, foodstuff fills the cup and the liquid flows through the perforated cup removing the foodstuff, and the liquid and the food stuff passes through the access port to a user in a controlled manner without the use of any utensil.

2. The push up cereal box of claim 1 further comprising a linking means to fixably attach the bottom compartment to the top compartment.

3. The push up cereal box of claim 1, wherein the bottom compartment containing the liquid is made of a flexible material for allowing a user to squeeze the liquid out of the tube.

4. The push up cereal box of claim 3, wherein the foodstuff is cereal and the liquid is milk.

5. The push up cereal box of claim 1 wherein the top compartment and the bottom compartment are microwaveable.

6. The push up cereal box of claim 1, wherein the liquid includes at least one of the following: milk, hot water, cold water, juice, coffee, tea, sports drink, soda, and any combination thereof.

7. The push up cereal box of claim 1, wherein the foodstuff includes at least one of the following: cereal; oatmeal; processed fruit; baby food; granola; tea leaves; ground coffee; food; and any combination thereof.

8. The push up cereal box of claim 2, wherein the linking means is hot glue.

9. The push up cereal box of claim 2, wherein the linking means is a snap fit.

10. A method of using a push up cereal box as recited in claim 1.

* * * * *